US006534928B1

(12) United States Patent
Li et al.

(10) Patent No.: US 6,534,928 B1
(45) Date of Patent: Mar. 18, 2003

(54) METHOD FOR DRIVING A FLAT-TYPE LAMP

(75) Inventors: Hsien Jen Li, Chang Hua County (TW); Chih Jung Yu, Yi Lan County (TW)

(73) Assignee: Delta Optoelectronics, Inc., Hsin-Chu (TW)

( * ) Notice: Subject to any disclaimer, the term of this patent is extended or adjusted under 35 U.S.C. 154(b) by 0 days.

(21) Appl. No.: 10/040,374

(22) Filed: Jan. 9, 2002

(30) Foreign Application Priority Data

Nov. 6, 2001 (TW) ..... 90127613 A

(51) Int. Cl.[7] ..... H05B 41/16
(52) U.S. Cl. ..... 315/246; 315/200 R; 315/209 R
(58) Field of Search ..... 315/246, 194, 315/200 R, 209 R, 291, 307, DIG. 5, 169.3

(56) References Cited

U.S. PATENT DOCUMENTS 6,239,558 B1 * 5/2001 Fujimura et al. ..... 315/307

* cited by examiner

*Primary Examiner*—Don Wong
*Assistant Examiner*—Tuyet T. Vo
(74) *Attorney, Agent, or Firm*—Bacon & Thomas, PLLC

(57) ABSTRACT

A method for driving a cold cathode flat fluorescent lamp (CCFFL). The method comprises the steps of generating a pulse-combined signal, applying the pulse-combined signal to an inverter driver circuit which is electrically connected to the CCFFL and causes it to light up, and adjusting the pulse width and the pulse period so that the CCFFL is at a maximum luminance while a luminance uniformity thereof is maximum. Based on the pulse width and the pulse period, the luminance uniformity of the CCFFL is constant while the CCFFL is adjusted for a desired luminance.

12 Claims, 2 Drawing Sheets

METHOD FOR DRIVING A FLAT-TYPE LAMP

BACKGROUND OF THE INVENTION

1. Field of the Invention

The present invention relates to a method for driving a cold cathode flat fluorescent lamp (CCFFL) and, more particularly, to a method for driving a CCFFL that enables the luminance uniformity of the CCFFL to be substantially constant while the CCFFL is adjusted for a desired luminance. Specifically, the method improves the luminance uniformity of the CCFFL when it is dim.

2. Description of the Related Art

The cold cathode flat fluorescent lamp (CCFFL) is used as a back-light source for an LCD display device or an LCD projector, or as a light source for a vehicle. The general construction of a CCFFL 100 is shown in FIG. 1, which is provided with a luminous surface 101, and a pair of electrodes 102 and 103. A conventional driving apparatus for the CCFFL 100 is composed of a power supply 104, a pulse generator 105, and an inverter driver 107, as shown in FIG. 2. In the conventional driving apparatus for the CCFFL 100, a conventional driving method for the CCFFL 100 comprises the steps of generating a pulse signal 106 by the pulse generator 105 of FIG. 2, applying the pulse signal 106 to the inverter driver 107, and generating a control signal by the inverter driver 107 to drive the CCFFL 100 to light up. In general, the control signal generated by the inverter driver 107 is a pulse signal or an alternating signal.

In addition, if it is necessary to adjust the luminance of the CCFFL 100, a pulse width $P_W$ of the pulse signal 106 of FIG. 3 is adjusted so as to alter the luminance of the CCFFL 100. Furthermore, a pulse period $P_T$ of the pulse signal 106 is set to be less than the time of visual persistence for human beings, so that the power consumption of the CCFFL 100 with the same luminance is reduced.

Thus, using the conventional driving method for the CCFFL 100, it is possible to alter the luminance of the CCFFL 100 and reduce the power consumption thereof by adjusting the pulse width $P_W$ and the pulse period $P_T$ of the pulse signal 106, respectively. However, due to the characteristic of the CCFFL 100, that is, when the pulse width $P_W$ is lowered to alter the luminance of the CCFFL 100, the luminance at electrodes 102 and 103 are brighter than the luminance at the central region of the luminous surface 101, such that a non-uniformity of luminance in the CCFFL 100 occurs. In addition, since the pulse width $P_W$ is lowered compared to the same pulse period $P_T$, the effective pulse period becomes longer, that is, it is equal to, or longer than, the time of visual persistence for human beings, thereby unstable luminance of the CCFFL 100 occurs.

Therefore, it is difficult to have a desired luminance uniformity while the CCFFL is adjusted for a desired reduced luminance using the conventional driving method for the CCFFL.

SUMMARY OF THE INVENTION

It is an object of the invention to provide a method for driving the cold cathode flat fluorescent lamp (CCFFL) for enabling the luminance uniformity of the CCFFL to be substantially constant while the CCFFL is adjusted for a desired luminance.

It is another object of the invention to provide a method for driving the CCFFL suitable for improving the luminance uniformity of the CCFFL when it is dim.

It is still another object of the invention to provide a method for driving the CCFFL suitable for reducing the power consumption thereof and preventing the luminance of the CCFFL from being unstable.

According to an aspect of the invention, there is provided the method for driving the CCFFL comprising the following steps: generating a pulse-combined signal, wherein the pulse-combined signal has a plurality of pulse signals, and each of the plurality of pulse signals has a pulse width and a pulse period; applying the pulse-combined signal to the inverter driver circuit, wherein the inverter driver circuit has a pair of output terminals, which are electrically connected to a pair of input terminals on the CCFFL so as to input a control signal to the CCFFL to light it up; adjusting the pulse width and the pulse period so that the CCFFL is at a first luminance while a first luminance uniformity thereof is maximum; setting the pulse width and the pulse period such that the CCFFL is at the first luminance and have the first luminance uniformity; and generating the pulse-combined signal having a turn-off time that allows the CCFFL to be at a second luminance and to have a second luminance uniformity; wherein the second luminance uniformity is substantially equal to the first luminance uniformity.

It is preferred that the step of generating the pulse-combined signal having the turn-off time comprises using a sinusoid-wave signal, a square-wave signal, or a triangle-shaped wave signal, and performing a modulating operation.

It is advantageous that the method for driving the CCFFL further comprises a step of generating the pulse-combined signal having a turn-on time that allows the CCFFL to be at a third luminance and to have a third luminance uniformity; wherein the third luminance uniformity is substantially equal to the first luminance uniformity.

It is preferred that the step of generating the pulse-combined signal having the turn-on time comprises using a sinusoid-wave signal, a square-wave signal, or a triangle-shaped wave signal, and performing a modulating operation.

It is preferred that the third luminance is the desired luminance of the CCFFL.

It is preferred that the third luminance is the first luminance of the CCFFL.

It is preferred that the first luminance is the maximum luminance of the CCFFL.

It is preferred that the second luminance is the desired luminance of the CCFFL.

Other objects and advantages of the present invention will become apparent from the detailed description to follow taken in conjunction with the appended claim.

DETAILED DESCRIPTION OF THE PREFERRED EMBODIMENT

FIG. 4 is a block diagram showing an example of the method for driving the CCFFL 200 according to the invention. As these devices are the same as those in FIG. 2 except of a signal-generating unit 205, an explanation of them is omitted here.

In FIG. 5, the signal-generating unit 205 is enabled by an enabling signal provided by a power supply 204 so as to generate a pulse-combined signal 206, wherein the pulse-combined signal 206 has a plurality of pulse signals, and there is a turn-on time $T_{on}$ or a turn-off time $T_{off}$ in the pulse-combined signal 206. Further, there are a plurality of successive pulse signals during the turn-on time $T_{on}$; meanwhile, each of the plurality of successive pulse signals is provided with a pulse width $P_W$ and a pulse period $P_T$.

Preferably, the turn-on time $T_{on}$, the turn-off time $T_{off}$, the pulse width $P_W$, and the pulse period $P_T$ as above-mentioned are adjusted and controlled by the signal-generating unit 205. According to the description of the method for driving the CCFFL 200 as follows, the signal-generating unit 205 is allowed to generate the pulse-combined signal 206 having an adequate pulse width $P_W$, an adequate pulse period $P_T$, and an adequate turn-on time $T_{on}$ or turn-off time $T_{off}$, which is subsequently input to an inverter driver 207. Based on the pulse-combined signal 206, the inverter driver 207 generates a control signal, preferably, a pulse signal or an alternating signal, so that the CCFFL 200 is driven to light up. In this way, by controlling the signal-generating unit 205 to generate the pulse-combined signal 206, it is possible to desirably adjust the luminance of the CCFFL 200 while the luminance uniformity of the CCFFL 200 substantially remains at the maximum.

As described above, the adequate pulse width $P_W$ and the adequate pulse period $P_T$ of the pulse-combined signal 206 generated by the signal-generating unit 205 are corresponded to allow the CCFFL 200, regardless of any luminance thereof, to have a substantially constant luminance uniformity. On the other hand, either the turn-on time $T_{on}$ or the turn-off time $T_{off}$ of the same is corresponded to allow the CCFFL 200 to be at a desired luminance, wherein the signal-generating unit 205 generates the pulse-combined signal 206 having either the turn-on time $T_{on}$ or the turn-off time $T_{off}$ by using any kind of alternating signal (such as a sinusoid-wave signal, a square-wave signal, or a triangle-shaped wave signal) and performing a modulation. Specifically, if there is no turn-off time $T_{off}$, the CCFFL 200 is at maximum luminance; and if there is no turn-on time $T_{on}$, the CCFFL 200 is at minimum luminance.

The signal-generating unit 205 is any electronic combination composed of electronic devices that can generate the waveform shown in FIG. 5, and it should be understood by a person skilled in the art that the signal-generating unit 205 is not restricted to a particular one, i.e., it could be any electronic circuit that can generates the pulse-combined signal 206.

Referring to FIGS. 4 and 5, the method for driving the CCFFL is described according to one embodiment of the invention. Firstly, as shown in FIG. 4, a set of pulse signals is generated by the signal-generating unit 205, wherein the set of pulse signals has a plurality of successive pulse signals, and each pulse signal has a pulse width $P_W$ and a pulse period $P_T$ shown in FIG. 5. Secondly, the set of pulse signals is applied to the inverter driver 207, and based on the set of pulse signals, the inverter driver 207 generates a control signal, preferably a pulse signal or an alternating signal, so that the inverter driver 207 can drive the CCFFL 200 to light up.

After the CCFFL 200 is driven to light up, the pulse width $P_W$ and the pulse period $P_T$ are adjusted so as to allow the CCFFL 200 to be substantially at a first luminance thereof, wherein the first luminance is substantially equal to the maximum luminance of the CCFFL 200. Subsequently, the values of luminance of a plurality of regions on the luminous surface are measured; preferably, the number of the plurality of regions is 9. Then, luminance uniformity is defined by calculating the ratio of the value of the minimum luminance to the value of the maximum luminance within a plurality of regions. In a case of keeping the maximum luminance of the CCFFL 200 substantially constant, the pulse width $P_W$ and the pulse period $P_T$ are adequately and repeatedly adjusted so as to allow the luminance uniformity to substantially equal a first luminance uniformity, wherein the first luminance uniformity is substantially equal to the maximum luminance uniformity of the CCFFL 200.

Then, the pulse width $P_W$ and the pulse period $P_T$ are set in order to subsequently adjust the desired luminance of the CCFFL 200. After that, the signal-generating unit 205 is firstly allowed to use any kind of alternating signal (such as a sinusoid-wave signal, a square-wave signal, or a triangle-shaped wave signal) and to perform a modulating operation, so that the pulse-combined signal 206 having a turn-off time $T_{off}$ is generated. Then, the pulse-combined signal 206 having a turn-off time $T_{off}$ is input to the inverter driver 207 so as to reduce the luminance of the CCFFL 200. Lastly, it is allowable to repeatedly input the pulse-combined signal 206 having either the turn-on time $T_{on}$ or the turn-off time $T_{off}$ to the inverter driver 207, so that the luminance uniformity of the CCFFL is substantially constant while the same is adjusted for the desired luminance; meanwhile, the pulse-combined signal 206 having a turn-on time $T_{on}$ is also generated by the signal-generating unit 205 using any kind of alternating signal (such as a sinusoid-wave signal, a square-wave signal, or a triangle-shaped wave signal) and performing a modulating operation. This method is suitable for improving the luminance uniformity of the CCFFL when it is dim.

According to the embodiment of the invention, it is preferred that a frequency of pulse corresponding to the pulse period $P_T$ is adjusted to a level of more than 60 Hz. In addition, according to the method of the invention, it is possible that the luminance uniformity of the CCFFL is substantially larger than 70%.

The invention may be embodied in other specific forms without departing from the spirit or essential characteristics thereof. The embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

Figure 1:
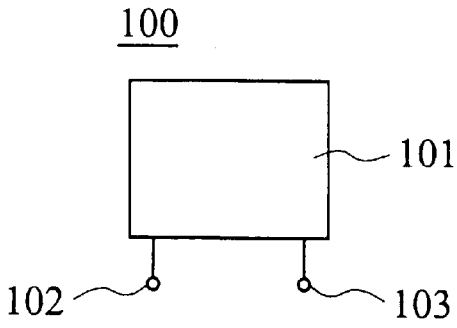
FIG. 1 PRIOR ART
FIG. 1 is a schematic diagram of a conventional CCFFL.
Figure 2:
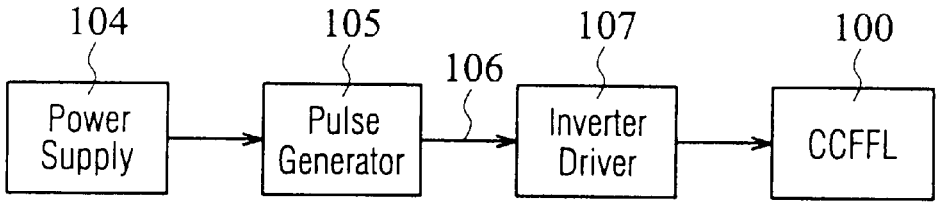
FIG. 2 PRIOR ART
FIG. 2 is a block diagram of a conventional driving method for a CCFFL.
Figure 3:
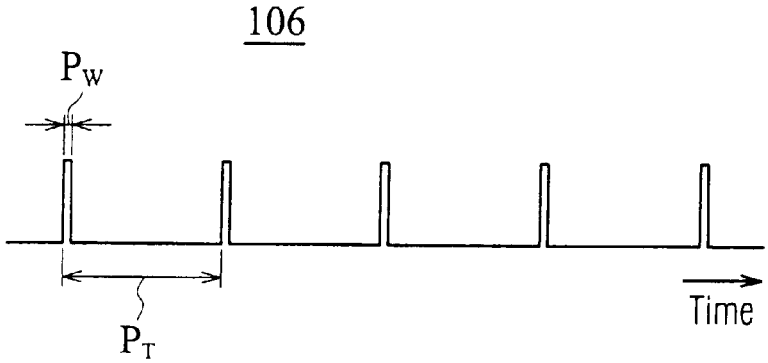
FIG. 3 PRIOR ART
FIG. 3 illustrates the waveform of a conventional pulse signal input to a CCFFL.
Figure 4:
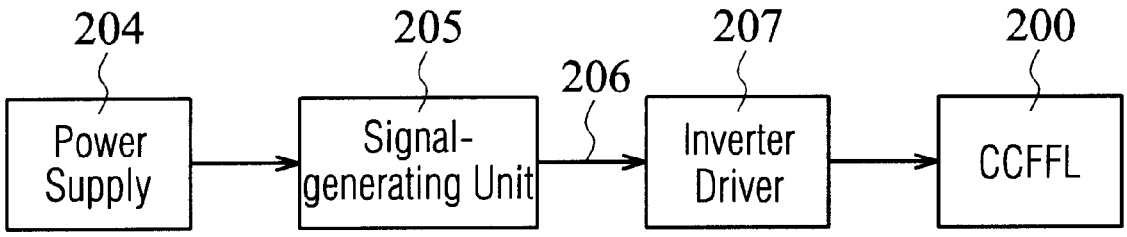
FIG. 4 is a block diagram showing the driving apparatus and method for a CCFFL according to one embodiment of the invention.
Figure 5:
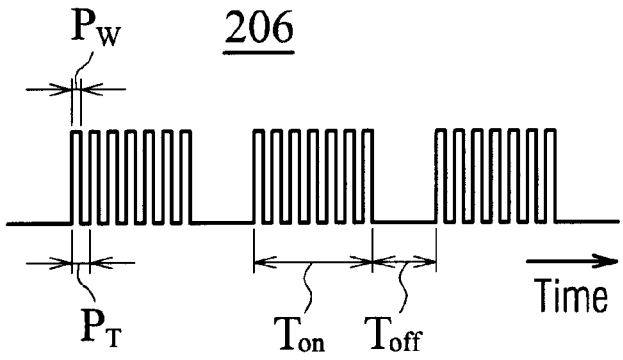
FIG. 5 illustrates the waveform of the pulse-combined signal input to a CCFFL according to one embodiment of the invention.

What is claimed is:

1. A method for driving a cold cathode flat fluorescent lamp (CCFFL), wherein a driver apparatus for the CCFFL is composed of a power supply, a signal-generating unit, and an inverter driver circuit, comprising the steps of:

generating a pulse-combined signal having a plurality of pulse signals, wherein each of the plurality of pulse signals has a pulse width and a pulse period;

applying the pulse-combined signal to the inverter driver circuit, wherein the inverter driver circuit has a pair of output terminals, which are electrically connected to a pair of input terminals of the CCFFL so as to input a control signal to the CCFFL to light it up;

adjusting the pulse width and the pulse period, so that the CCFFL can be at a first luminance while a first luminance uniformity thereof is at a substantially maximum level;

setting the pulse width and the pulse period so that the CCFFL is at the first luminance and have the first luminance uniformity; and generating the pulse-combined signal having a turn-off time that allows the CCFFL to be at a second luminance and to have a second luminance uniformity;

wherein the second luminance uniformity is substantially equal to the first luminance uniformity.

2. The method as recited in claim 1, wherein the step of generating the pulse-combined signal having the turn-off time comprises using a sinusoid-wave signal, and performing a modulating operation.

3. The method as recited in claim 1, wherein the step of generating the pulse-combined signal having the turn-off time comprises using a square-wave signal, and performing a modulating operation.

4. The method as recited in claim 1, wherein the step of generating the pulse-combined signal having the turn-off time comprises using a triangle-shaped wave signal, and performing a modulating operation.

5. The method as recited in claim 1, wherein the first luminance is substantially equal to the maximum luminance of the CCFFL.

6. The method as recited in claim 1, wherein the second luminance is a desired luminance of the CCFFL.

7. The method as recited in claim 1, further comprising the step of:

generating the pulse-combined signal having a turn-on time that allows the CCFFL to be at a third luminance and to have a third luminance uniformity;

wherein the third luminance uniformity is substantially equal to the first luminance uniformity.

8. The method as recited in claim 7, wherein the step of generating the pulse-combined signal having the turn-on time comprises using a sinusoid-wave signal, and performing a modulating operation.

9. A The method as recited in claim 7, wherein the step of generating the pulse-combined signal having the turn-on time comprises using a square-wave signal, and performing a modulating operation.

10. The method as recited in claim 7, wherein the step of generating the pulse-combined signal having the turn-on time comprises using a triangle-shaped wave signal, and performing a modulating operation.

11. The method as recited in claim 7, wherein the third luminance is a desired luminance of the CCFFL.

12. The method as recited in claim 7, wherein the third luminance is the first luminance of the CCFFL.

* * * * *